US012404643B2

(12) United States Patent
Mall et al.

(10) Patent No.: US 12,404,643 B2
(45) Date of Patent: Sep. 2, 2025

(54) PRECAST TRAFFIC BARRIER SOUNDWALL

(71) Applicant: CDS Manufacturing, Inc., Gretna, FL (US)

(72) Inventors: Michael E. Mall, Gretna, FL (US); Clayton Sembler, Gretna, FL (US)

(73) Assignee: CDS Manufacturing, Inc., Gretna, FL (US)

( * ) Notice: Subject to any disclaimer, the term of this patent is extended or adjusted under 35 U.S.C. 154(b) by 849 days.

(21) Appl. No.: 17/680,676

(22) Filed: Feb. 25, 2022

(65) Prior Publication Data

US 2022/0267973 A1 Aug. 25, 2022

Related U.S. Application Data

(60) Provisional application No. 63/153,547, filed on Feb. 25, 2021.

(51) Int. Cl.
*E01F 15/08* (2006.01)

(52) U.S. Cl.
CPC ..... *E01F 15/08* (2013.01)

(58) Field of Classification Search
CPC ... E01F 15/00; E01F 15/08; E01F 8/00; E01F 15/081; E01F 8/005; E01F 8/0011; E01F 8/0064; E01F 8/007; E01F 8/0076; E01F 8/0082; B64F 1/26
See application file for complete search history.

(56) References Cited

U.S. PATENT DOCUMENTS 4,325,457 A * 4/1982 Docherty ..... E01F 8/0029 181/294
4,685,656 A * 8/1987 Lee ..... E04H 17/16 256/19
5,406,039 A * 4/1995 Rerup ..... E01F 8/0011 181/294
6,016,887 A * 1/2000 Underhill ..... E01F 15/083 181/210
6,434,900 B1 * 8/2002 Masters ..... E01F 8/0023 256/73

(Continued)

OTHER PUBLICATIONS

Case-in-place barrier, known since 2010 and published on the Internet on the dates indicated on the documents available at https://fdotwww.blob.core.windows.net/sitefinity/docs/default-source/design/standardplans/2024/idx/521-510.pdf?

(Continued)

*Primary Examiner* — Abigail A Risic
(74) *Attorney, Agent, or Firm* — Geoffrey Lottenberg; Berger Singerman LLP

(57) ABSTRACT

A traffic barrier soundwall includes a top portion attached to a bottom portion. The segments are reinforced by rebar, mesh, or combinations thereof. Dowel rods extend from the bottom edge of the top portion which fit into corresponding pipe sections along the top edge of the bottom portion. Grout is flowed into the pipe sections and an epoxy is applied along the length of the joining surfaces. The upper corners of each of the top and bottom portions have expansion troughs to accommodate hardware to attach the segments to adjacent segments. The bottom portion is generally T-shaped with a tapered cross-section. The footer of the bottom portion is installed under the ground level and connection plates attach the footers of adjacent segments to one another.

17 Claims, 17 Drawing Sheets

(56) References Cited

U.S. PATENT DOCUMENTS

| | | | | |
|---|---|---|---|---|
| 6,851,887 | B2 * | 2/2005 | Lembo | E01F 15/083 404/6 |
| 7,104,720 | B2 * | 9/2006 | Humphries | E01F 15/083 404/9 |
| 7,144,186 | B1 * | 12/2006 | Nolte | E01F 15/083 404/6 |
| 10,221,529 | B1 * | 3/2019 | Sanders | H02G 3/386 |
| 10,335,707 | B2 * | 7/2019 | Nunes | A63K 1/00 |
| 10,385,526 | B1 * | 8/2019 | Caval | E01F 13/026 |
| 10,767,325 | B2 * | 9/2020 | Humphries | E01F 8/0023 |
| 2005/0178613 | A1 * | 8/2005 | Humphries | E04H 17/168 181/210 |
| 2006/0118354 | A1 * | 6/2006 | Corbin, Jr. | E01F 8/007 181/210 |
| 2007/0131480 | A1 * | 6/2007 | Corbin, Jr. | E01F 8/007 181/210 |
| 2010/0008721 | A1 * | 1/2010 | Lass | E01F 15/025 404/6 |
| 2013/0025217 | A1 * | 1/2013 | Corbin, Jr. | E01F 8/0011 52/745.1 |
| 2013/0081901 | A1 * | 4/2013 | Zimmerman | E01F 8/0011 181/284 |
| 2015/0218763 | A1 * | 8/2015 | Smith | E01F 15/088 404/6 |
| 2016/0340896 | A1 * | 11/2016 | Hoshino | E04B 1/8209 |
| 2019/0211518 | A1 * | 7/2019 | Humphries | E01F 15/083 |
| 2020/0149235 | A1 * | 5/2020 | Wawrzynek | E01F 15/083 |
| 2021/0062442 | A1 * | 3/2021 | Ramaekers | E01F 13/12 |
| 2021/0292983 | A1 * | 9/2021 | Alberson | E01F 8/0011 |

OTHER PUBLICATIONS

Case-in-place barrier, known since 2010 and published on the Internet on the dates indicated on the documents available at https://fdotwww.blob.core.windows.net/sitefinity/docs/default-source/design/standardplans/2024/idx/521-511.pdf?

* cited by examiner (Plan View)

(Plan View)

(Plan View)

(Plan View)

(Plan View)

(Plan View)

(Plan View)

(Plan View)

(Plan View)

(Elevation View)

(Plan View)

(Elevation View)

(Elevation View)

(Plan View)

PRECAST TRAFFIC BARRIER SOUNDWALL

CROSS REFERENCE TO RELATED APPLICATIONS

This application claims priority to U.S. Provisional Application No. 63/153,547 filed on Feb. 25, 2021.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE INVENTION

In the following description, for the purposes of explanation, numerous specific details are set forth in order to provide a thorough understanding of the invention. It will be apparent, however, to one skilled in the art that the invention may be practiced without some of these specific details. Throughout this description, the embodiments and examples shown should be considered as exemplars, rather than as limitations on the invention. That is, the following description provides examples, and the accompanying drawings show various examples for the purposes of illustration. However, these examples should not be construed in a limiting sense as they are merely intended to provide examples of the invention rather than to provide an exhaustive list of all possible implementations of the invention.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment.

Furthermore, the particular features, structures or characteristics may be combined in any suitable manner in one or more embodiments.

Figure 1:
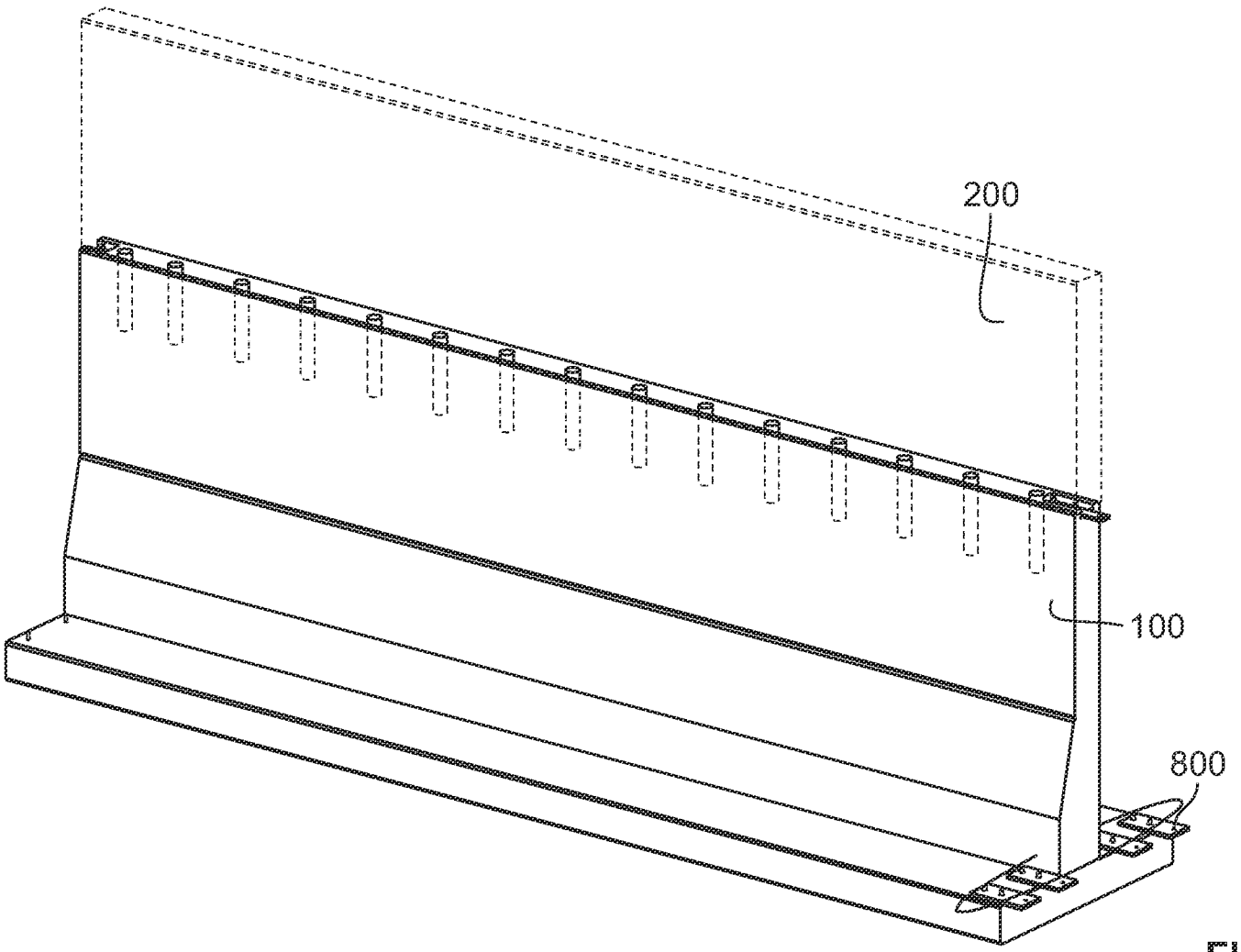
FIG. 1 is a perspective view of a segment the traffic barrier soundwall (TBSW).

FIG. 1 is a perspective view of the traffic barrier soundwall (TBSW). Shown is a TBSW segment having a precast bottom portion 100 which retains a precast top portion 200. The bottom portion 100 is installed in the ground with reinforcement as described herein and the top portion 200 is disposed on top of the bottom portion. In the depicted embodiment the assembled TBSW is 16 feet tall, but when installed in the ground the total stanchion wall height is 14 feet, with the footer 2 foot under the ground. In some embodiments, a plurality of top portions 200 can be stacked on one another to achieve a taller overall barrier wall. Connection plates 800 can be used to connect adjacent segments.

Figure 2A:
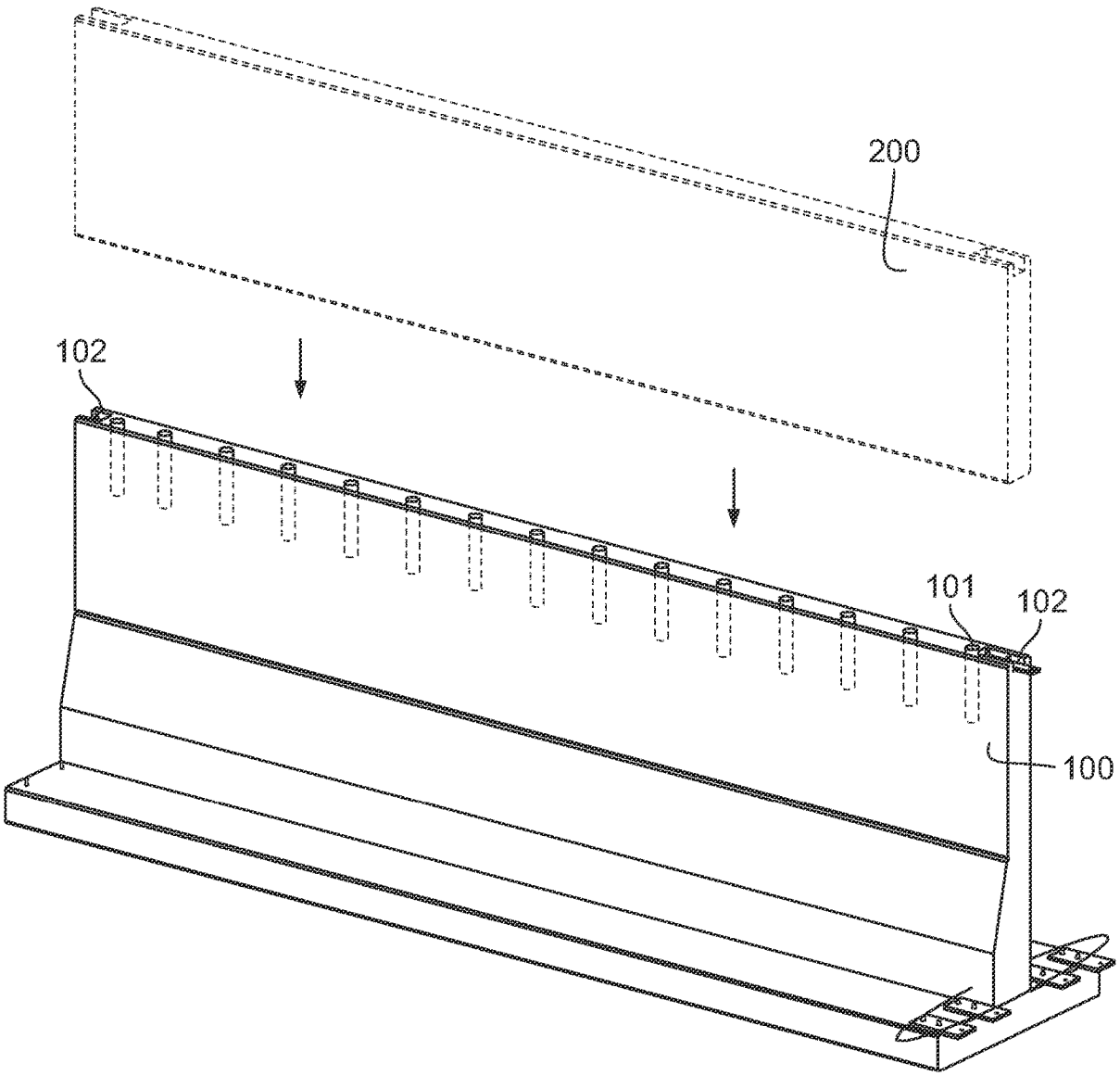
FIG. 2A is a schematic view of the TBSW segment showing the top portion separated from the bottom portion.
Figure 2B:
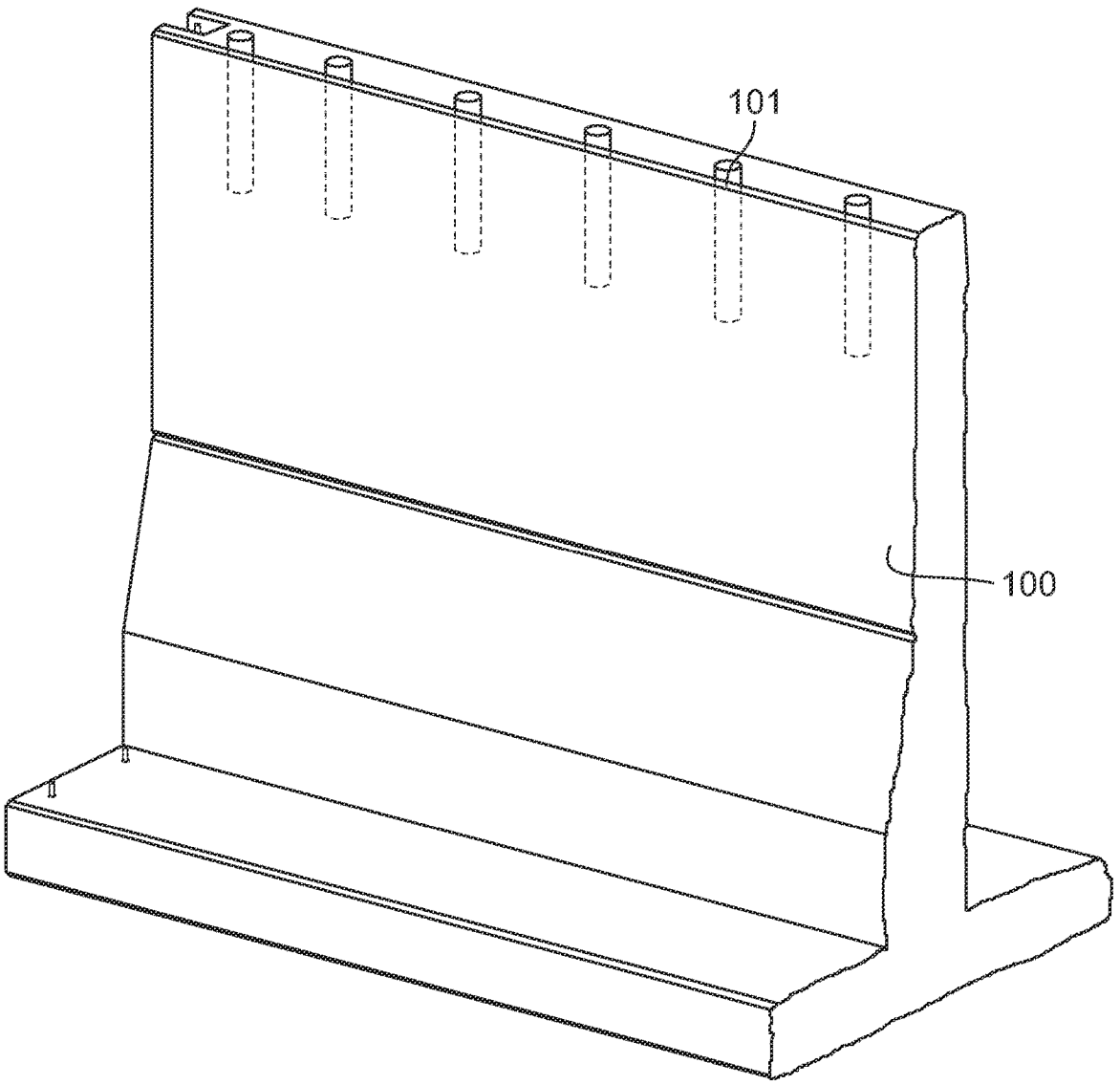
FIG. 2B is a schematic view of the TBSW segment showing the top portion attached to the bottom portion.
Figure 3A:
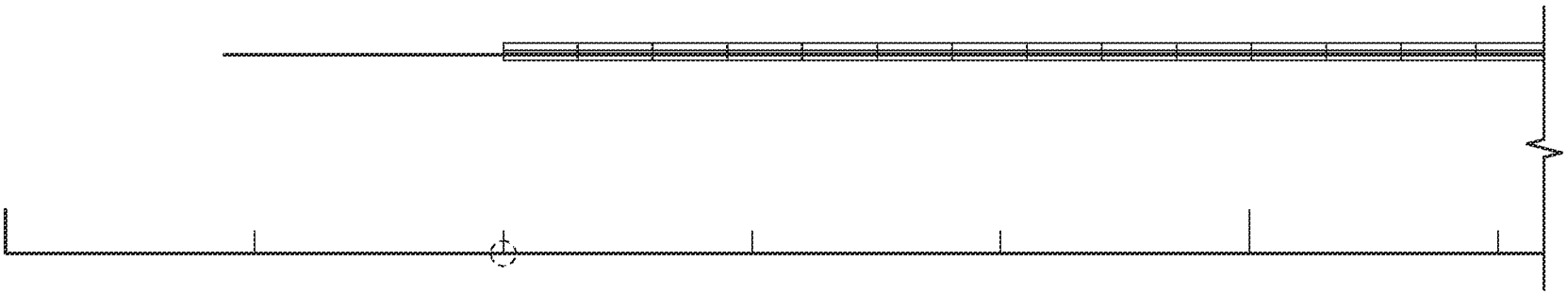
FIG. 3A is a top plan view of the TBSW system comprising a plurality of TBSW segments.
Figure 3B:
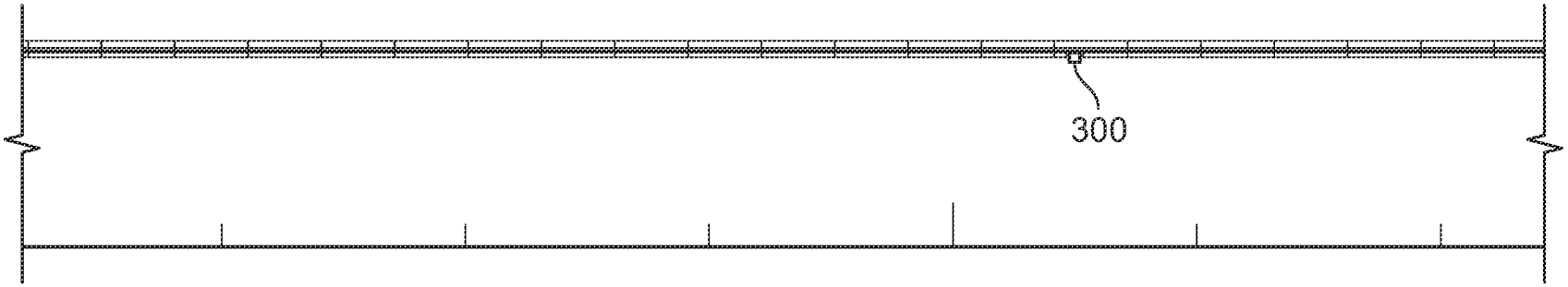
FIG. 3B is a top plan view of another embodiment of the TBSW system comprising a plurality of TBSW segments.
Figure 4A:
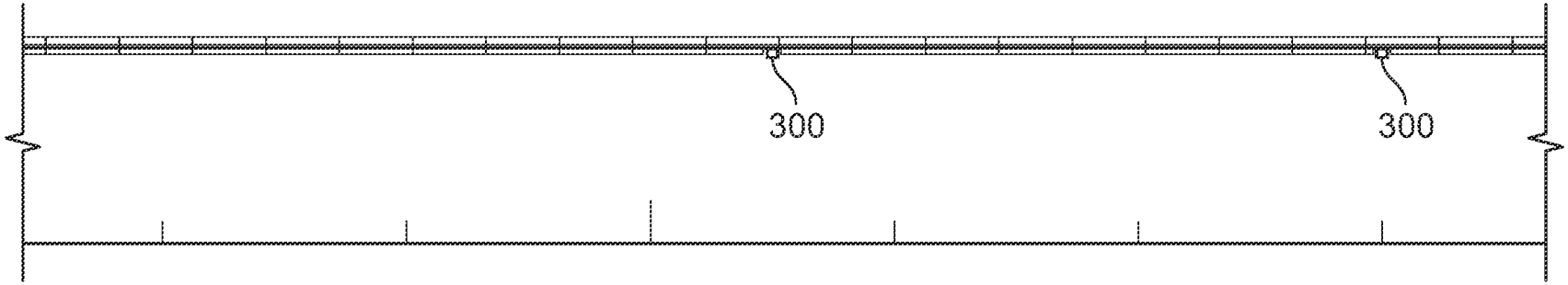
FIG. 4A is a top plan view of yet another embodiment the TBSW system comprising a plurality of TBSW segments.
Figure 4B:
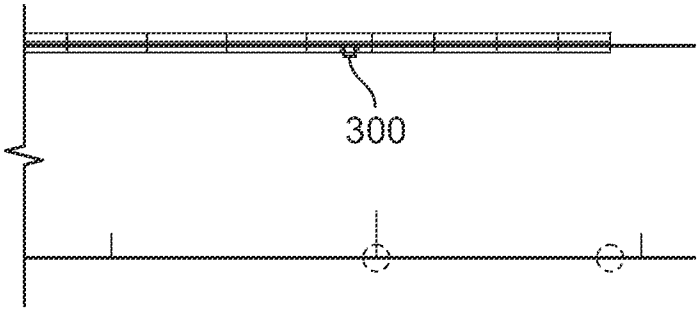
FIG. 4B is a top plan view of yet another embodiment of the TBSW system comprising a plurality of TBSW segments.
Figure 5A:
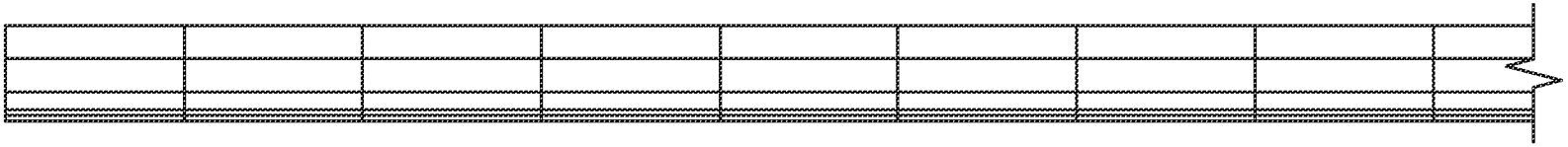
FIG. 5A is a front elevation view of the TBSW system comprising a plurality of TBSW segments.
Figure 5B:
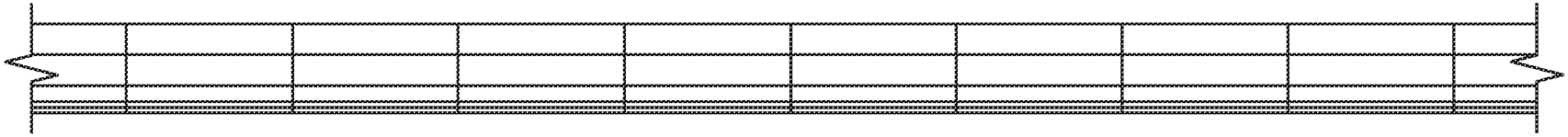
FIG. 5B is a front elevation view of another embodiment of the TBSW system comprising a plurality of TBSW segments.
Figure 5C:
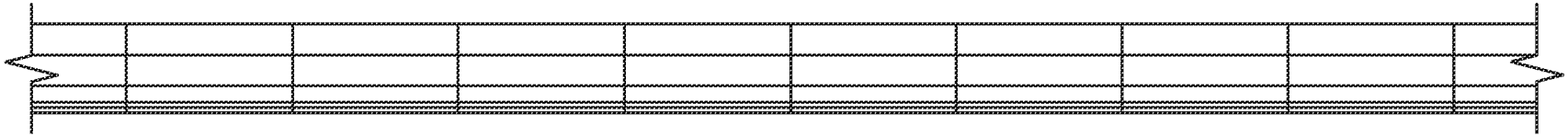
FIG. 5C is a front elevation view of yet another embodiment of the TBSW system comprising a plurality of TBSW segments.
Figure 6A:
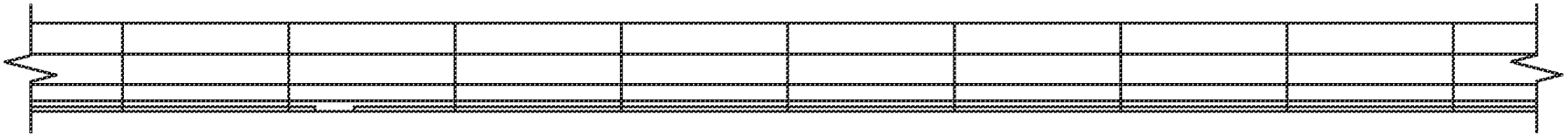
FIG. 6A is a front elevation view of the TBSW system comprising a plurality of TBSW segments.
Figure 6B:
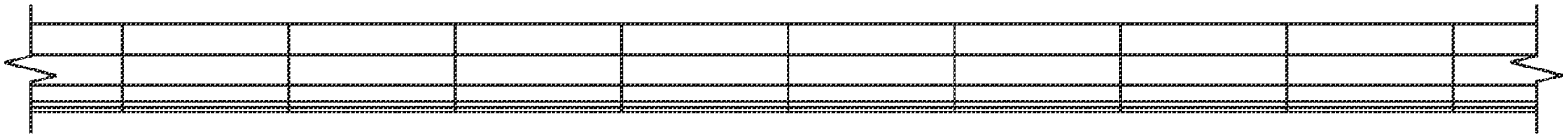
FIG. 6B is a front elevation view of another embodiment of the TBSW system comprising a plurality of TBSW segments.
Figure 6C:
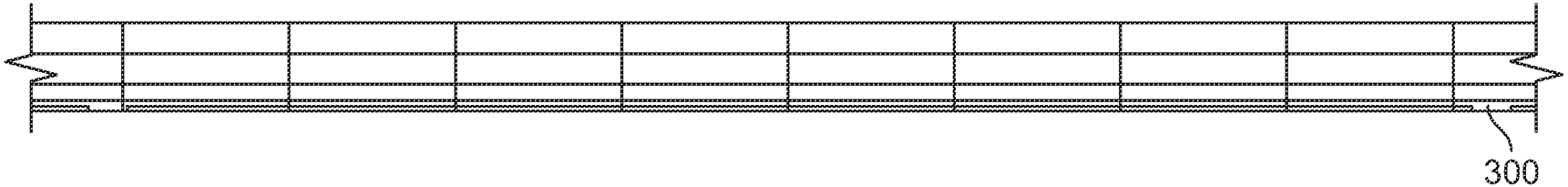
FIG. 6C is a front elevation view of yet another embodiment of the TBSW system comprising a plurality of TBSW segments.
Figure 10:
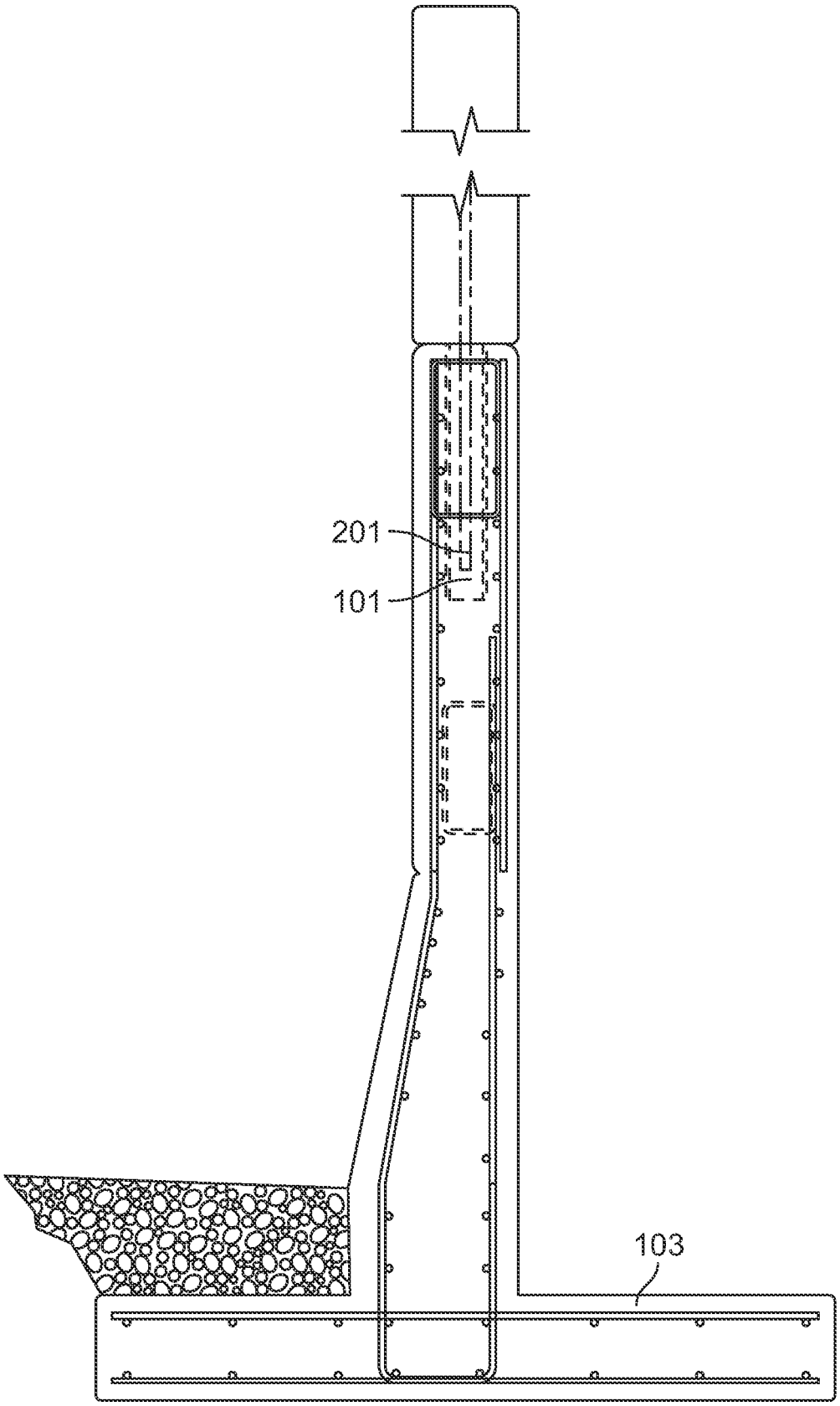
FIG. 10 is cross-section view of the TBSW segment showing the assembly and rebar reinforcement.

FIG. 2A is a schematic view of the TBSW showing the top portion 200 exploded away from the bottom portion 100. FIG. 2B is a close up of the bottom portion 100 In some embodiments, the top portion 200 is secured to the bottom portion 100 by a high-strength epoxy. One or more corrugated metal pipe sections 101 are disposed along the top edge of the bottom portion. The pipe sections 101 extend from the top edge of the bottom portion longitudinally, and are configured to receive retaining dowel rods 201 extending from the bottom edge of the top portion (see FIG. 10). As shown in FIG. 10, the dowel rods 201 extending substantially vertically and outwardly from the top edge of the top portion are received by the embedded longitudinally extending pipe sections 101. In some embodiments, the pipe sections 101 are filled with grout or other filler. In some embodiments, a high strength epoxy is used to secure the top portion to the bottom portion. Further still, a silicone sealant may be used around the joints to finalize the connection and to block noise transmission. In some embodiments the upper corners of each of the top and bottom portions include expansion troughs 102 and 202 (202 shown in FIGS. 15A-15B), respectively, which allow for connection to an adjacent TBSW segment. In some embodiments, the expansion troughs 102 and 202 are configured to accept and retain fasteners and other hardware in order to mechanically connect adjacent segments. The troughs 102 and/or 202 may also be flooded with a filler material such as grout, concrete, or epoxy in order to enhance the connection, cover hardware, and provide a finished look.

Figure 7A:
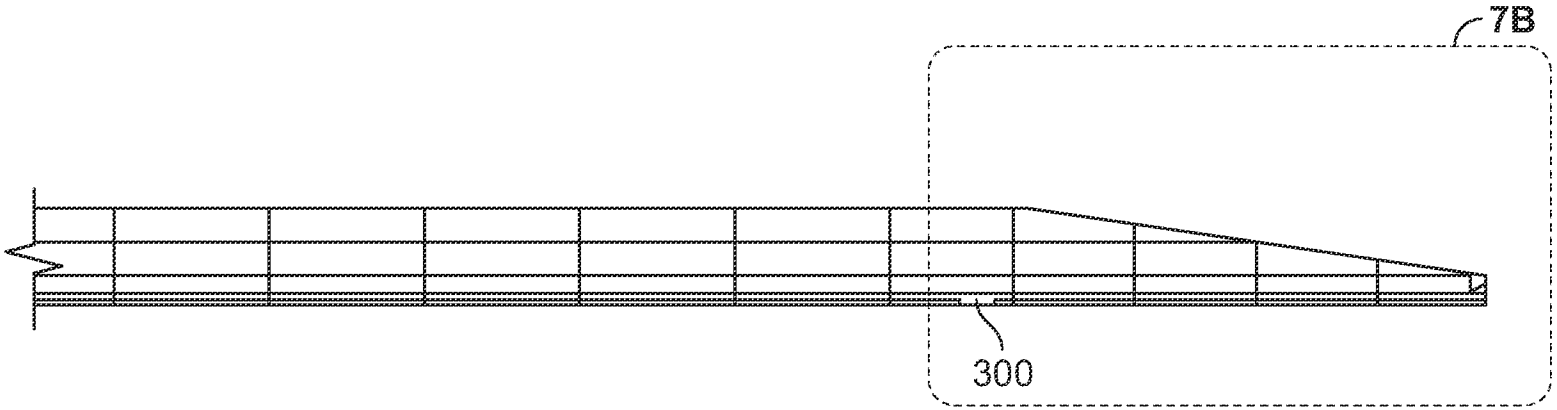
FIG. 7A is a front elevation view of a portion of the TBSW system showing a sloping end segment.
Figure 7B:
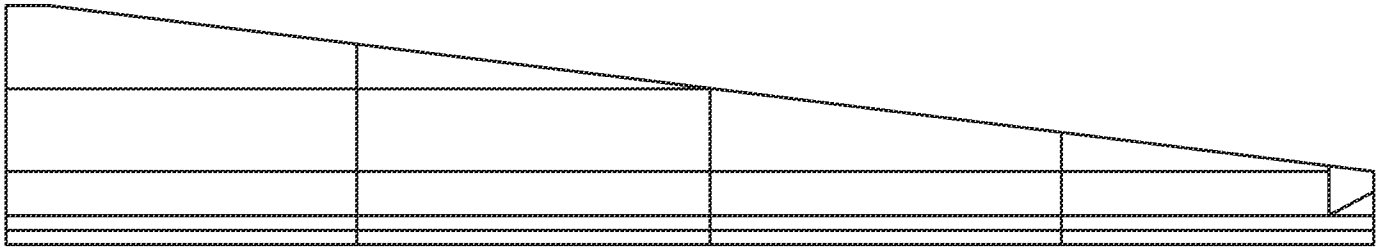
FIG. 7B is a close-up front elevation view of the TBSW system showing the sloping end segment from FIG. 7A.
Figure 8A:
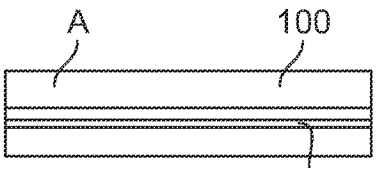
FIG. 8A is a top plan view of a rectangular TBSW segment.
Figure 8B:
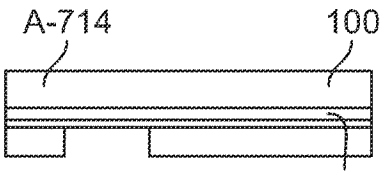
FIG. 8B is a top plan view of an offset voided TBSW segment.
Figure 8C:
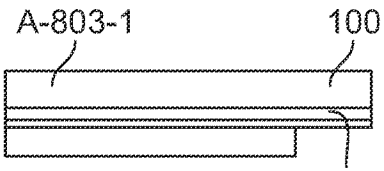
FIG. 8C is a top plan view of an end-voided TBSW segment.
Figure 8D:
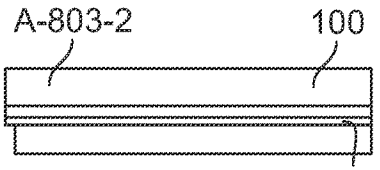
FIG. 8D is a top plan view of another embodiment of an end-voided TBSW segment.
Figure 8E:
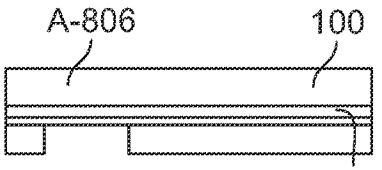
FIG. 8E is a top plan view of yet another embodiment of an offset voided TBSW segment.
Figure 8F:
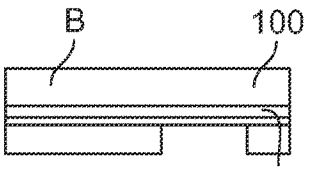
FIG. 8F is a top plan view of yet another embodiment of an offset voided TBSW segment.
Figure 8G:
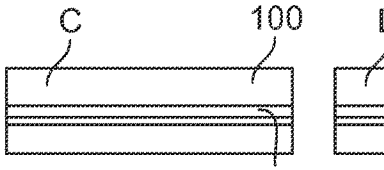
FIG. 8G is a top plan view of another embodiment of a rectangular TBSW segment.
Figure 8H:
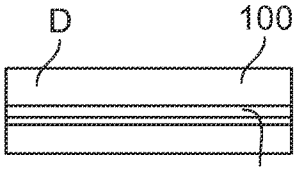
FIG. 8H is a top plan view of yet another embodiment of a rectangular TBSW segment.
Figure 8I:
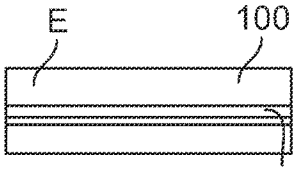
FIG. 8I is a top plan view of a sloped TBSW segment.
Figure 8J:
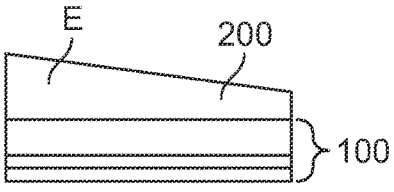
FIG. 8J is a front elevation view of the sloped TBSW segment shown in FIG. 8I.
Figure 8K:
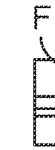
FIG. 8K is a top plan view of another embodiment of a sloped TBSW segment.
Figure 8L:
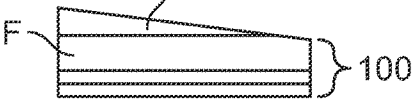
FIG. 8L is a front elevation view of the sloped TBSW segment shown in FIG. 8K.

FIGS. 3A-3B and 4A-4B are top plan views of two embodiments of the TBSW segments configured as complete soundwall barriers installed adjacent to a road, such as a highway or expressway. FIGS. 5A-5C and 6A-6C are corresponding front elevation views. In some embodiments, the TBSW segments include voids 300 to accommodate structure such as median barriers and other elements. FIGS. 7A-7B are front elevations views of a sloped end or transition TBSW segment.

With reference to FIGS. 8A-8L, shown are various embodiments of the TBSW segments having varying shapes and relative dimension. As shown, "Type A" segments have generally rectangular top portions to form a wall of a uniform height In some embodiments, transition segments are implemented, such as "Type B," "Type C", "Type D," "Type E," and "Type F," which have top portions 100 of various shape and dimensions.

Figure 9A:
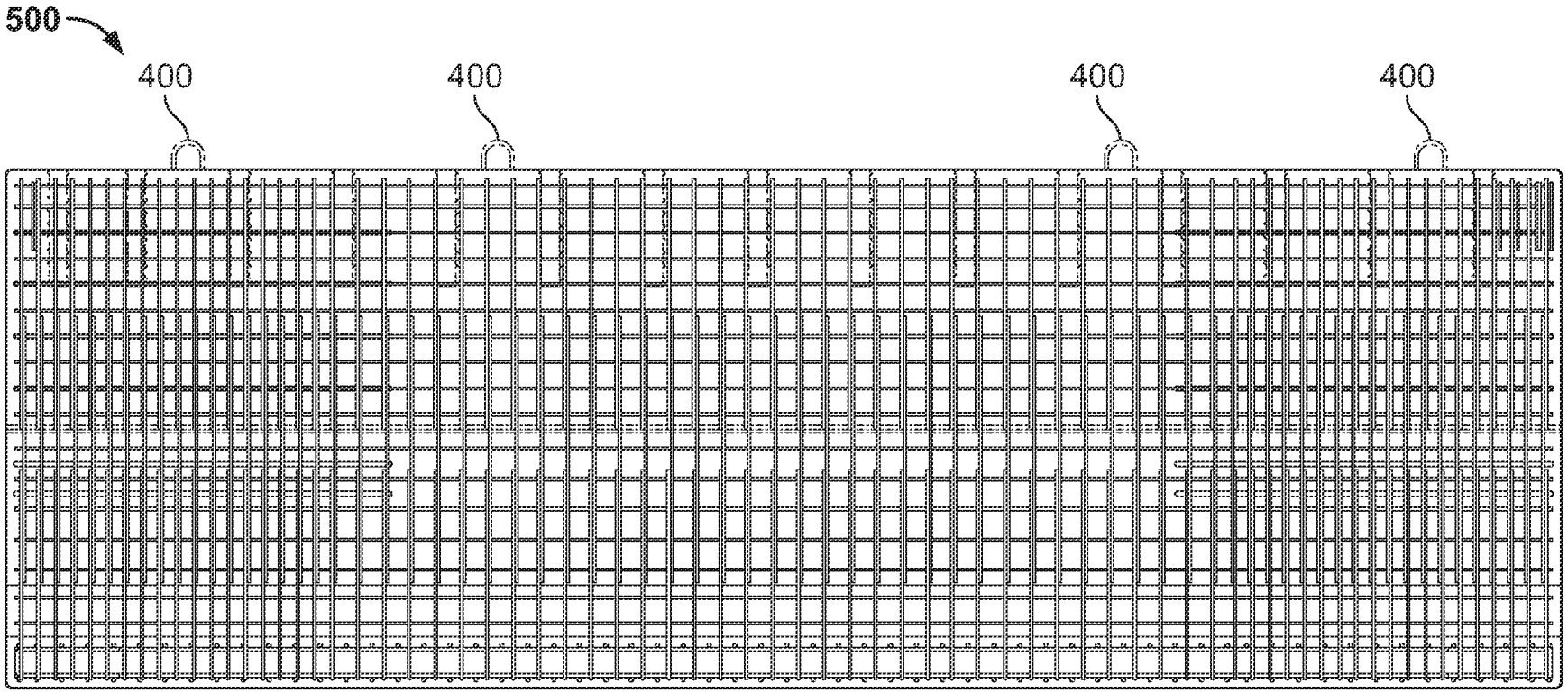
FIG. 9A is a detailed view of the TBSW segment showing reinforcement structure.
Figure 9B:
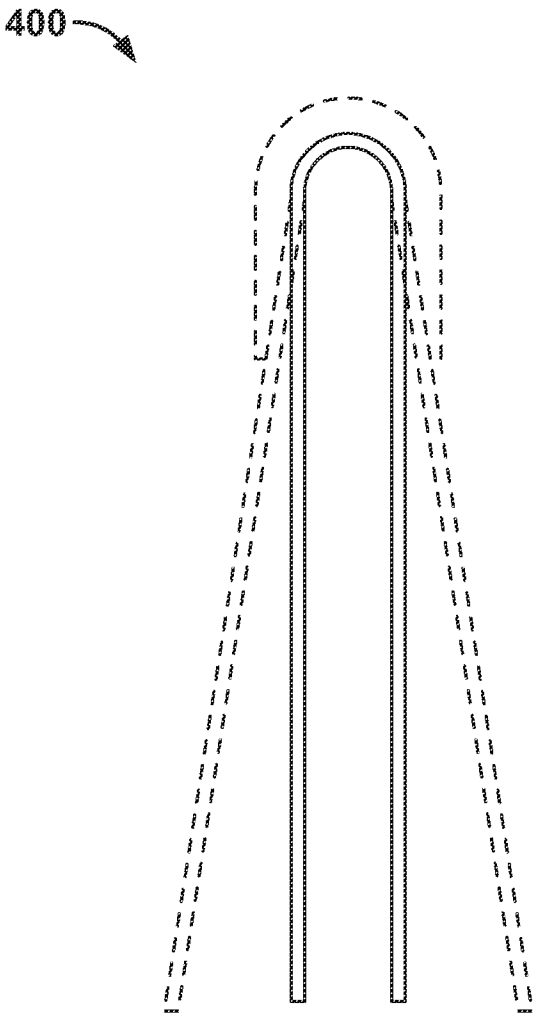
FIG. 9B shows an embodiment of a lifting loop.

FIG. 9A is a cutaway elevation view of the bottom portion 100 of the TBSW showing its reinforcement structure. Here, a matrix or lattice 500 of reinforcing bar (rebar) is disposed at the interior of the bottom portion. Also shown are one or more lifting loops 400 along the top edge of the bottom portion which are used as attachment points to facilitate handling, moving, locating, and installing the segments. In some embodiments, the lifting loops 400 are coextensive with the rebar matrix 500. FIG. 9B shows a close up of the lifting loop 400, with the dotted lines showing the available expansion of the loop 400 to tie into reinforcing steel or other structure.

FIG. 10A is a cross-section view of the bottom portion 100 of a TBSW segment. Here it is seen that the cross-section is generally T-shaped although in some embodiments the stanchion wall ("leg" of the T) tapers outwardly on one side toward the footer 103 (base of the "T"). The footer 103 is configured to be disposed under the surface of the ground with the stanchion wall extending upward therefrom. Here the various rebar sections are shown disposed at the interior of the bottom portion, including the stanchion wall and footer. Also shown is the fitment of the dowel rods 201 of the top portion 200 into the pipe sections 101 of the bottom portion 100.

Figure 11:
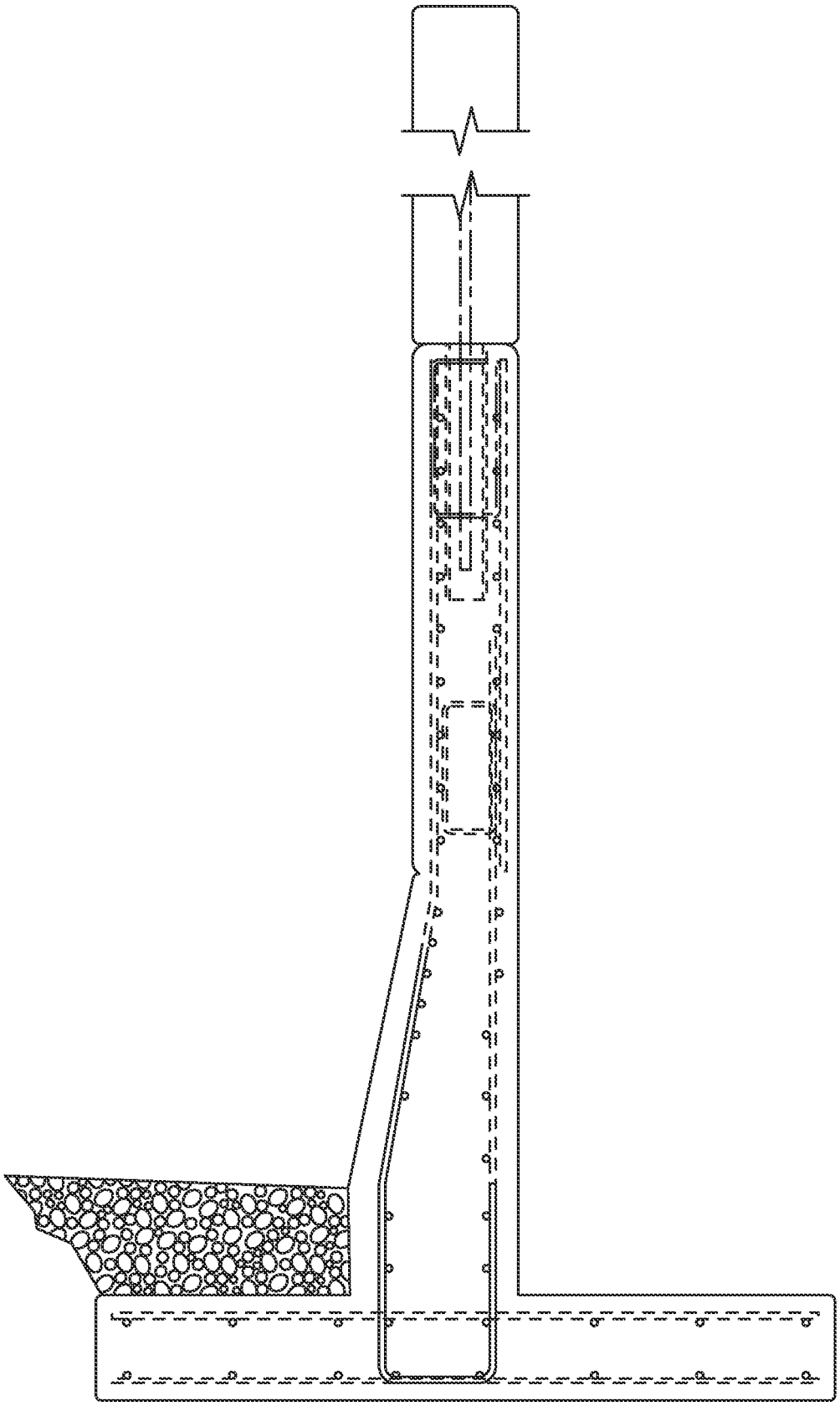
FIG. 11 is cross-section view of the TBSW segment showing the assembly and mesh-rebar reinforcement.
Figure 12:
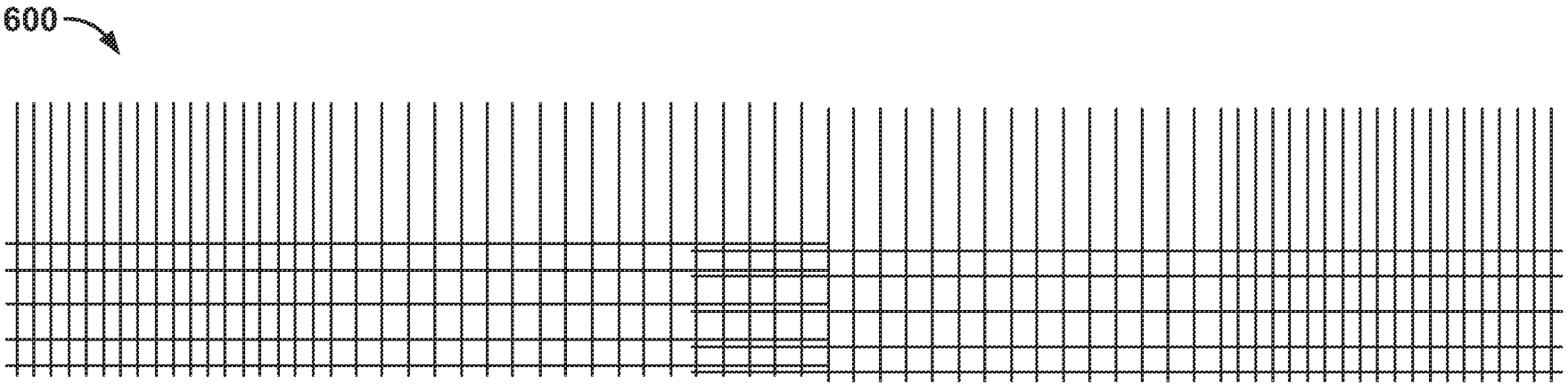
FIG. 12 shows the wire mesh reinforcement aspect of the TBSW segment.

Alternatively, as shown in FIG. 11, a combination of mesh (dotted lines) and rebar (solid lines) may be used as reinforcement, with the mesh disposed vertically along the interior of the stanchion wall and horizontally along the interior of the base section, with at least a portion of the rebar disposed perpendicular to the mesh. FIG. 12 shows an embodiment of a mesh matrix 600 forming at least a portion of the reinforcement.

Figure 13C:
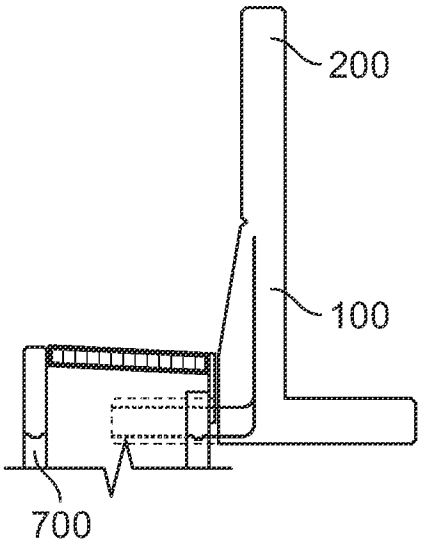
FIG. 13C is an end view of the voided TBSW segment shown in FIG. 13A.
Figure 13A:
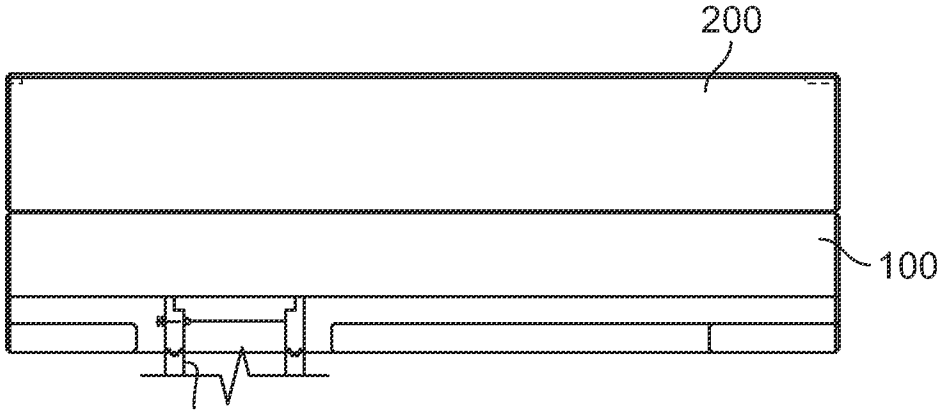
FIG. 13A is a front elevation view of a voided TBSW segment accommodating a median barrier.
Figure 13B:
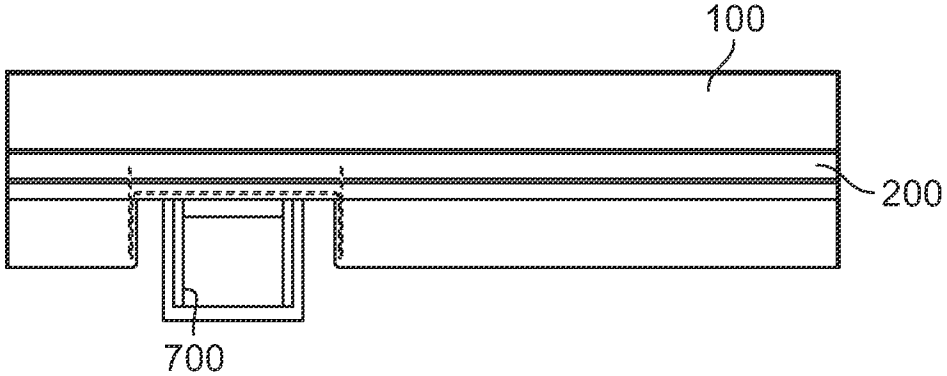
FIG. 13B is a top plan view of the voided TBSW segment shown in FIG. 13A.

FIGS. 13A-13C show embodiments of the TBSW segments having voids to accommodate additional structures such as a median barrier 700.

Figure 14:
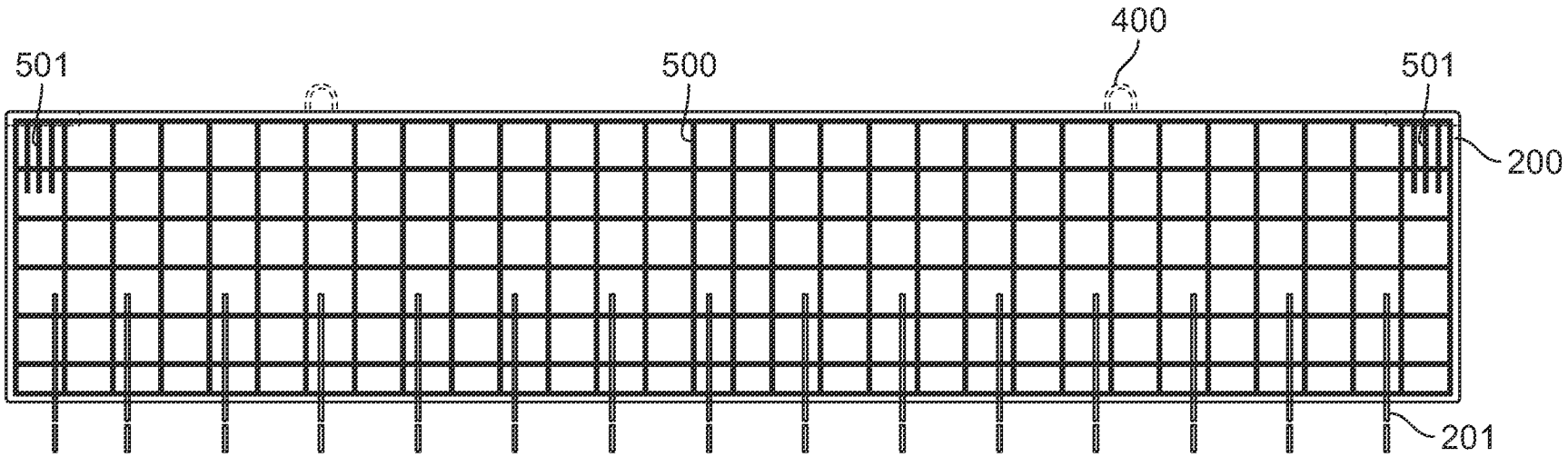
FIG. 14 is an elevation view of top portion of the TBSW segment showing its reinforcement structure.

FIG. 14 is an elevation view of top portion 200 of the TBSW showing its reinforcement structure. Rebar is provided in a grid or matrix 500 configuration as shown. The grid 500 may also include trimmable rebar sections 501 at the corners of the top portion 200 to clear notches and other geometry. Lifting loops 400 are also provided which, like the lifting loops on the bottom portion, may be coextensive with the rebar. Also show are the dowel rods 201 extending down from the bottom edge of the top portion, which fit into the pipe sections along the top edge of the bottom portion 100 (not shown).

Figure 15A:
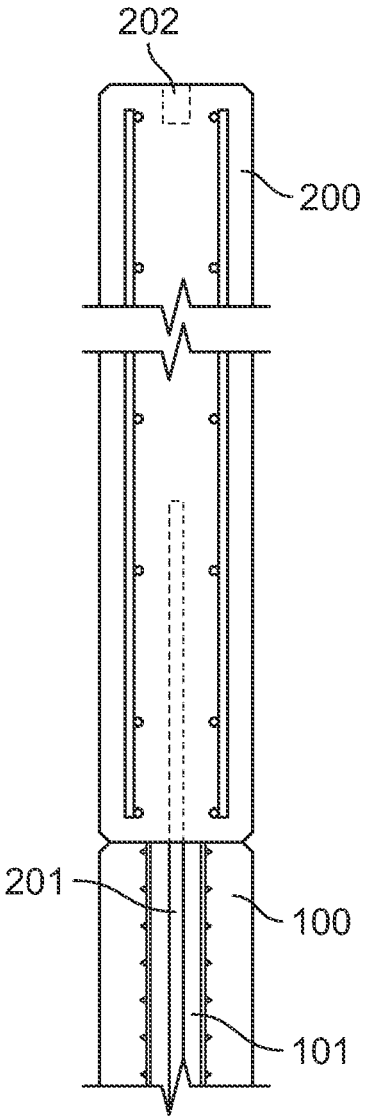
FIG. 15A shows the top portion of the TBSW segment in cross-section, showing the rebar reinforcement structure disposed at the interior thereof.
Figure 15B:
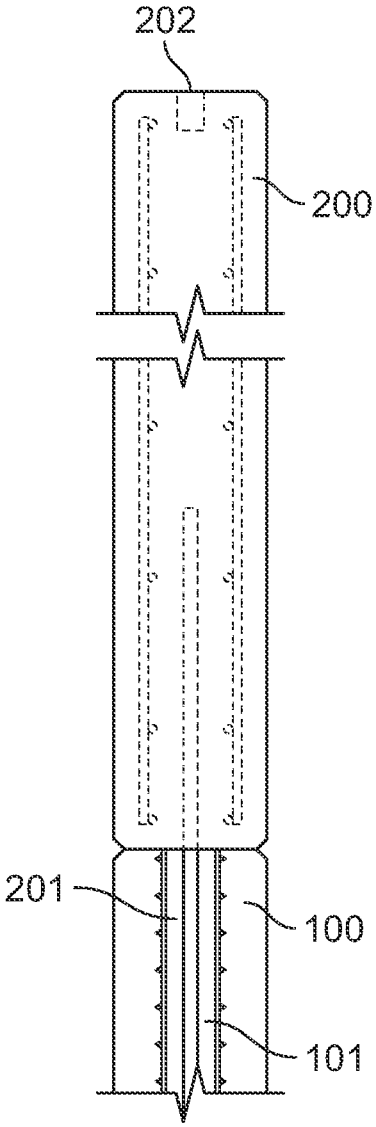
FIG. 15B shows the top portion of the TBSW segment in cross-section, showing the mesh-rebar reinforcement structure disposed at the interior thereof.

FIGS. 15A-15B are cross-section end views showing the connection of the top portion 200 to the bottom portion 100 including the insertion of the down rod 201 into the pipe section 101. Also shown expansion troughs 202 at the top edge of the top portion 100 which can be used to accommodate connections such as brackets to attached adjacent top portions 200.

It is to be noticed that the term "comprising," used in the claims, should not be interpreted as being limitative to the means listed thereafter. Thus, the scope of the expression "a device comprising means A and B" should not be limited to devices consisting only of components A and B. It means that with respect to the present invention, the only relevant components of the device are A and B. Put differently, the terms "including", "comprising" and variations thereof mean "including but not limited to", unless expressly specified otherwise.

Similarly, it is to be noticed that the term "coupled", also used in the claims, should not be interpreted as being limitative to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means.

The enumerated listing of items does not imply that any or all of the items are mutually exclusive, unless expressly specified otherwise. The terms "a", "an" and "the" mean "one or more", unless expressly specified otherwise.

Elements of the invention that are in communication with each other need not be in continuous communication with each other, unless expressly specified otherwise. In addition, elements of the invention that are in communication with each other may communicate directly or indirectly through one or more other elements or other intermediaries.

One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that any alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. A traffic barrier soundwall, comprising:

a solid top portion disposed on a solid bottom portion, the top and bottom portion reinforced by rebar, mesh, or combinations thereof; and wherein dowel rods extend substantially vertically from the bottom edge of the top portion, the dowel rods inserted into corresponding longitudinally extending pipe sections embedded in the bottom portion and disposed along the top edge of the bottom portion.

2. The traffic barrier soundwall of claim 1, wherein the bottom portion has a generally T-shaped cross section comprising a stanchion wall substantially perpendicular to a footer.

3. The traffic barrier soundwall of claim 2, wherein one side of the stanchion wall tapers outwardly toward the footer.

4. The traffic barrier soundwall of claim 2, wherein connection plates secure the footer of the bottom portion to a footer of an adjacent bottom portion.

5. The traffic barrier soundwall of claim 2, wherein the footer accommodates one or more brackets to attach the bottom portion to an adjacent bottom portion.

6. The traffic barrier soundwall of claim 1, wherein the top and bottom portions each include lifting loops coextensive with the reinforcement.

7. The traffic barrier of claim 1, wherein grout is flowed into the pipe sections.

8. The traffic barrier of claim 1, wherein epoxy is applied at least one joining surface of the top or bottom portion.

9. A traffic barrier soundwall system, comprising:

a plurality of traffic barrier soundwall segments each comprising a solid top portion disposed on a solid bottom portion, the top and bottom portion reinforced by rebar, mesh, or combinations thereof;

wherein dowel rods extend substantially vertically from the bottom edge of the top portion, the dowel rods inserted into corresponding longitudinally extending pipe sections embedded in the bottom portion and disposed along the top edge of the bottom portion; and wherein the upper corners of each of the top and bottom portions include expansion troughs to accommodate hardware such that the respective segments can be attached to adjacent segments.

10. The traffic barrier soundwall system of claim 9, wherein the bottom portion has a generally T-shaped cross section comprising a stanchion wall substantially perpendicular to a footer.

11. The traffic barrier soundwall system of claim 10, wherein one side of the stanchion wall tapers outwardly toward the footer.

12. The traffic barrier soundwall system of claim 10, wherein connection plates secure the footer of the bottom portion to a footer of an adjacent bottom portion.

13. The traffic barrier soundwall system of claim 10, wherein the footer accommodates one or more brackets to attach the bottom portion to an adjacent bottom portion.

14. The traffic barrier soundwall system of claim 9, wherein the top and bottom portions each include lifting loops coextensive with the reinforcement.

15. The traffic barrier soundwall system of claim 9, wherein grout is flowed into the pipe sections.

16. The traffic barrier soundwall system of claim 9 wherein epoxy is applied at least one joining surface of the top or bottom portion.

17. A traffic barrier soundwall, comprising:

a solid top portion disposed on a solid bottom portion, the top and bottom portion reinforced by rebar, mesh, or combinations thereof;

wherein dowel rods extend substantially vertically from the bottom edge of the top portion, the dowel rods inserted into corresponding longitudinally extending pipe sections embedded in the bottom portion and disposed along the top edge of the bottom portion;

wherein the bottom portion has a generally T-shaped cross section comprising a stanchion wall substantially perpendicular to a footer; and wherein one side of the stanchion wall tapers outwardly toward the footer.

* * * * *